United States Patent [19]

Schilling

[11] 4,364,423

[45] Dec. 21, 1982

[54] ROTATING DISC SPLITTER

[75] Inventor: Walter W. Schilling, Delta, Canada

[73] Assignee: MacMillan Bloedel Limited, Vancouver, Canada

[21] Appl. No.: 199,182

[22] Filed: Oct. 21, 1980

[51] Int. Cl.[3] ..... B27L 7/00

[52] U.S. Cl. ..... 144/366; 83/114; 144/193 R; 144/362

[58] Field of Search ..... 83/114, 156, 408, 906; 144/182, 193 R, 323, 326 R, 2 R, 362, 366; 241/236, 221, 227, 235

[56] References Cited

U.S. PATENT DOCUMENTS

| | | | |
|---|---|---|---|
| 7,592 | 5/1833 | Beal et al. | 144/182 |
| 546,294 | 9/1895 | Birkner | 144/193 R |
| 560,231 | 5/1896 | Riggs | 83/114 |
| 682,228 | 9/1901 | Parker | 144/184 |
| 1,376,789 | 5/1921 | Williams . | |
| 1,691,102 | 11/1928 | Witham, Sr. | 144/193 R |
| 1,725,176 | 8/1929 | Bevis | 83/114 |
| 2,006,106 | 6/1935 | Markert | 83/114 |
| 2,084,921 | 6/1937 | Skliris | 83/425.3 |
| 3,044,510 | 7/1962 | Schneider et al. | 144/193 R |
| 3,650,168 | 3/1972 | Ruschmann | 83/114 |
| 3,674,219 | 7/1972 | Harvey, Jr. | 144/2 R X |
| 3,727,850 | 4/1973 | Krigbaum | 241/236 |
| 3,797,765 | 3/1974 | Samuels | 241/236 |

FOREIGN PATENT DOCUMENTS

| | | |
|---|---|---|
| 15279 | 9/1901 | Sweden . |

*Primary Examiner*—W. D. Bray

*Attorney, Agent, or Firm*—Schuyler, Banner, Birch, McKie & Beckett

[57] ABSTRACT

A method and apparatus for splitting wood slabs substantially along the wood grain into longitudinal-grain wood strands are provided. The apparatus comprises a rotating disc splitter having a pair of parallel rotary shafts each having centered thereon and secured thereto a series of spaced apart circular discs, means for counter rotating the shafts to pull a slab of wood between the series of discs and to split the slab into strands, and a series of floating spacer rings on each shaft interspaced between the discs, the floating spacer rings being positioned on either side of the shafts adapted to permit the spacer rings to move away from the discs when a slab is being split therebetween. The method comprises inserting an end of a slab of wood between counter rotating discs, a first series of discs pushing first sections of the slab in one direction perpendicular to the direction of travel of the slab and perpendicular to the axes of the counter rotating discs, a second series of discs interfitting with the first series of discs pushing second sections of the slab between the first sections in an opposite direction to the one direction thus causing splitting to occur between first sections and second sections of the slab and forming strands, and guiding the first sections and second sections of the slab downstream of the counter rotating discs to issue as substantially straight strands from the counter rotating discs.

8 Claims, 4 Drawing Figures

ROTATING DISC SPLITTER

This invention relates to splitting wood into strands. More particularly, this invention relates to a method and apparatus for splitting wood slabs substantially along the wood grain into long longitudinal-grain wood strands.

Long wood strands, with longitudinal-grain extending along their length, are required for the production of adhesively bonded structural lumber products. An example of one type of structural lumber product is disclosed in U.S. Pat. No. 4,061,819, issued Dec. 6, 1977. In accordance with this invention, wood slabs are split with a rotating disc splitter to provide wood strands.

Rotating disc cutters, slicers and slitters are well known. However, in the past these devices have generally been used for cutting thin material such as cloth, paper or rubber which is not only thin but is also reasonably flexible. As such material passes between the two rows of rotating discs, the discs cut or slit the material which results in ribbons of the flexible material exiting from between the rotating discs. This invention, on the other hand, deals with wood slabs. In certain embodiments the slabs may be up to approximately one inch thick, and it is required to split the slabs substantially along the wood grain rather than to merely cut the slabs. Cutting a slab, for example, does not generally follow the wood grain, and thus does not produce wood strands with the grain extending along the length of the wood. When one end of a slab of wood having the grain extending substantially lengthwise is fed between rotating discs, the wood slab, being a rigid material, tends to commence splitting along the grain, and the split or crack extends upstream of the pair of rotating discs. Thus, the split occurs in advance of the contact made between the slab and the discs. Because the wood is split, the sides of the strands are somewhat uneven and there is a tendency for the wood strands to become wedged between adjacent discs. As the discs continue to rotate, wedged strands are bent or curled. When flexible material such as paper is passed between two intermeshing rotating discs, any tendency to curl (as long as the ribbons do not wrap around the discs) does not matter because the ribbons are flexible. In the case of wood strands, however, it is preferable not to allow the strands to curl, because the resulting strands tend to contain broken fibers which reduce the strength of the strands and consequently the strength of the structured lumber products in which the strands are used.

It is an object of the present invention to provide a rotating disc splitter for wood slabs which prevents excessive curling of the strands produced, thus minimizing the breakage of fibers in the strands.

In accordance with the present invention, there is provided an apparatus for splitting a slab of wood into strands with longitudinal-grain extending along their length, comprising a first rotary shaft and a second rotary shaft whose axes are parallel, a first series of spaced-apart circular discs centered on and secured to the first shaft, a second series of spaced-apart circular discs centered on and secured to the second shaft, positioned so that the second series discs interfit in slightly overlapping relationship with the first series discs, means for rotating the first shaft and the second shaft in counter rotating directions adapted to pull a slab of wood between the first and second series discs and split the slab into strands, a first series of floating spacer rings on the first shaft interspaced between the first series discs, positioned to rest adjacent the second series discs when no slab passes therethrough, a second series of floating spacer rings on the second shaft interspaced between the second series discs, positioned to rest adjacent the first series discs when no slab passes therethrough, fixed roller means positioned upstream of the first and second shafts to prevent the first and second series spacer rings from moving upstream of the first and second series discs, and pressure movable roller means positioned on the downstream side of the first and second shafts, adapted to permit the first and second series spacer rings to move away from the second and first series discs respectively when a slab is being split therebetween, said upstream and downstream roller means adapted to provide a point of contact between the floating rings and the wood strands which is downstream of the axes of said first and second shafts.

The present invention also provides a method of splitting a slab of wood substantially along the grain into a plurality of strands, comprising the steps of: inserting an end of a slab of wood between counter rotating discs, a first series of discs pushing first sections of the slab in one direction perpendicular to the direction of travel of the slab and perpendicular to the axes of the counter rotating discs, a second series of discs interfitting with the first series of discs pushing second sections of the slab between the first sections in an opposite direction to the one direction thus causing splitting to occur between first sections and second sections of the slab and forming strands, and guiding the first sections and second sections of the slab downstream of the counter rotating discs to issue as substantially straight strands from the counter rotating discs.

In drawings which illustrate embodiments of the invention,

Figure 1:
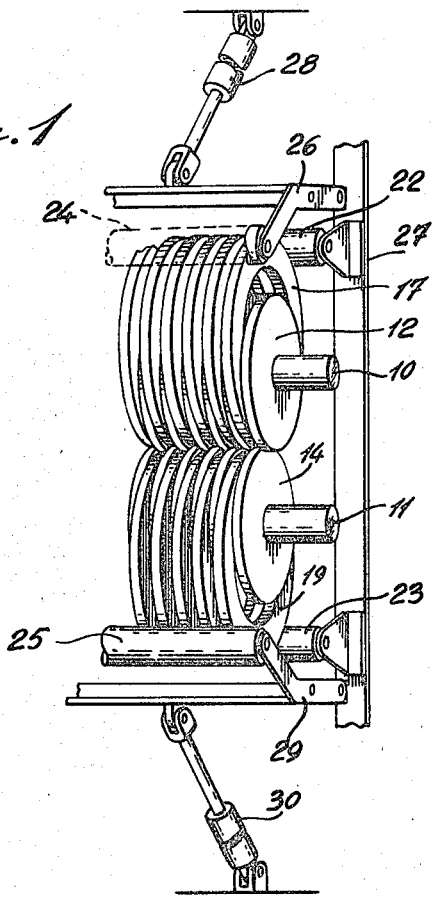
FIG. 1 is a perspective view of a rotating disc splitter according to one embodiment of the present invention.

Referring now to the drawings, the rotating disc splitter has a first shaft 10 rotating on a horizontal axis with a second shaft 11 spaced apart and parallel to the first shaft 10. In the embodiment shown, the first shaft 10 is vertically displaced from the second shaft 11. The first shaft 10 has a first series of spaced apart circular discs 12 which are integrally connected to the shaft 10 by means of a key 13. The second shaft 11 has a second series of spaced apart circular discs 14 integrally connected to the second shaft 11 by a key 15. The second series discs 14 are positioned on the second shaft 11 so that they interfit in slightly overlapping relationship with the first series discs 12 on the first shaft 10. In the embodiment shown, both the first and second series discs 12 and 14 are the same diameter and the same width. The spacing between the first series discs 12 and the second series discs 14 is just sufficient for the interfitting discs to rotate against each other without interference. Each of the first series discs 12 has a hub 16 which abuts against the adjacent disc 12. The hub 16 has a width sufficient for the second series discs 14 to interfit between the first series discs 12 without interference. The hubs 16 have a diameter considerably less than the circular discs 12 and support floating spacer rings 17 between each of the circular discs 12. The floating spacer rings 17 have an internal diameter considerably greater than the outside diameter of the hubs 16, thus the rings 17 float within this space between the circular discs 12 being restricted by the inside diameter of the floating rings 17 and the outside diameter of the hubs 16. The movement of the floating rings 17 is constrained to be downstream and away from the intermesh between the discs. The floating rings 17 (and 19) may have the same outside diameter as discs 12 (or 14) but preferably have a larger outside diameter so that the rings more readily can be positioned to contact the strands downstream of the centerline of the discs and insure that the strands are disengaged from the discs without undue binding. Most desireably, the floating rings contact the wood strands at a point between the centerline of the rotating discs and the point at which the strands exit from between the discs.

Each of the second series discs 14 also has a hub 18 which abuts against adjacent discs 14. Second series floating spacer rings 19 fit between the circular discs 14 and have an internal diameter considerably greater than the outside diameter of the hubs 18 thus allowing the rings 19 to float. Spacer rings 19 and discs 14 are counterparts to spacer rings 17 and discs 12.

Figure 2:
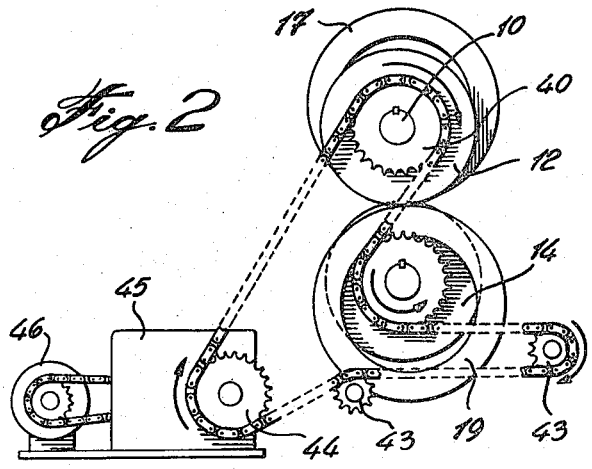
FIG. 2 is a side view of the rotating disc splitter of FIG. 1 showing the drive arrangement.
Figure 4:
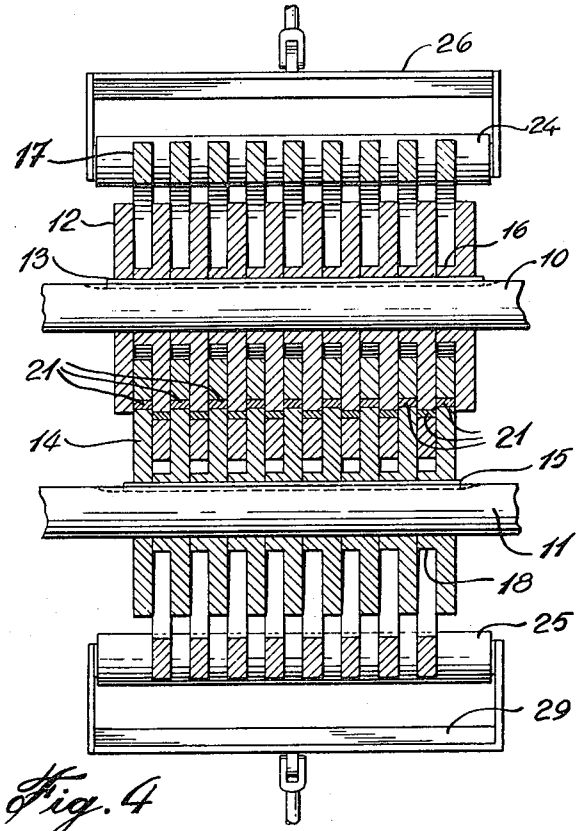
FIG. 4 is a cross-sectional elevation taken at line 4—4 of FIG. 3.
Figure 3:
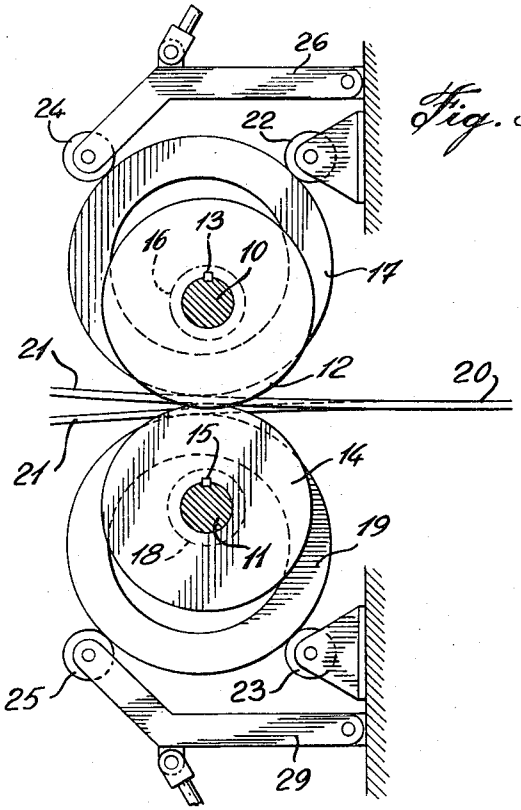
FIG. 3 is an end cross-sectional elevation through the rotating disc splitter shown in FIG. 1.

The first shaft 10 and the second shaft 11 rotate in opposite directions as shown in FIG. 2 and the drive mechanism will be described in more detail hereafter. The rotating force is sufficient for the circular discs 12 and 14 to pull a slab 20 of wood through the rotating disc splitter, while at the same time splitting the slab 20 of wood into strands 21. Positioned upstream of the first series discs 12 and adjacent thereto is a first fixed position roller 22 preferably located in the upper quadrant and desireably at a radial angle from the center of the discs 12 in the approximate range of about 20° to about 70° from the path of a slab 20 passing between the circular discs 12 and 14. Positioned upstream of the second series discs 14, and adjacent thereto is a second fixed position roller 23 located at approximately the same angle as the position of the first roller 22 only below the path of a slab 20 passing between the circular discs 12 and 14; that is, the roller is in the lower upstream quadrant and most desireably at a radial angle from the center of discs 14 of from about 20° to about 70° from the path of the slab. One position of the fixed rollers is illustrated in FIG. 3. The two fixed position rollers 22 and 23 rest against the floating rings 17 and 19 and prevent the floating rings from moving to a position upstream of the rotating discs 12 and 14.

A top movable position roller 24 is shown located above the first series discs 13 and a bottom movable position roller 25 is shown positioned below the second series discs 14. The top roller 24 is supported on a trunnion frame 26 pivoted from a main frame 27. A hydraulic cylinder 28 applies a pressure to the top roller 24. The bottom roller 25 is also supported on a trunnion frame 29 pivoted from the main frame 27, and a second hydraulic cylinder 30 applies a pressure to the bottom roller 25. Movable roller 24 is located in the upper downstream quadrant of disc 12 and is most desireably located within a radial angle from the center of disc 12 of from about 20° to about 70° above the path of the slab. Similarly, movable roller 25 is located in the lower downstream quadrant of disc 14 and is most desireably located within a radial angle from the center of disc 14 of from about 20° to about 70° below the path of the slab. Movable rollers 24 and 25 allow a movement of the spacer rings 17 of approximately 1 inch above the circular discs 12 and a movement of the spacer rings 19 of approximately 1 inch below the circular discs 14.

When a slab 20 passes between the circular discs 12 and 14 the floating rings 17 and 19 are pushed against the top and bottom movable position rollers 24 and 25 which in turn are pushed against the pneumatic cylinders 28 and 30. The pressure in the pneumatic cylinders is such that the floating rings 17 and 19 move just a sufficient amount to allow the strands to pass but always exert pressure on the strands 21 and prevent them from jamming between the circular discs.

The drive mechanism shown in FIG. 2 includes a first chain sprocket 40 mounted on the end of the first shaft 10 and a second chain sprocket 41 mounted on the end of the second shaft 11. A chain drive 42 drives the two sprockets 40 and 41 so that they rotate in opposite directions. Two sprocket idlers 43 force the chain to follow the desired path, and the chain 42 is driven from a drive sprocket 44 from a gear box 45 and constant speed motor 46.

In operation of the rotating disc splitter, it is first necessary for an operator to push a slab 20 between the circular discs 12 and 14. As the slab 20 is pushed in, it commences to split, and the split extends upstream on the slab 20. The circular discs 12 push first sections of the slab 20 downwards in a direction which is perpendicular to the direction of travel of the slab 20 and perpendicular to axes of the counter rotating discs 12 and 14. The circular discs 14 push the intervening sections of the slab 20 upwards directly opposite to the downwards direction, so splitting occurs between the sections of the slab 20. The split always remains upstream of the circular discs 12 and 14. The resulting strands 21 exit from between the circular discs 12 and 14 in two elevations with adjacent strands staggered between the two elevations. As soon as splitting commences the split strands 21 are gripped by the circular discs 12 and 14 which are rotating and thus pull the slab 20 through the rotating disc splitter. To prevent the strands 21 from jamming between the circular discs 12 and 14, the floating rings 17 and 19 press on the strands 21 at a position just downstream of the circular discs 12 and 14 but desireably upstream of the point at which the strands exit from between adjacent discs. The floating rings 17 and 19 are forced into this downstream position by the fixed position rollers 22 and 23 which prevent the floating rings 17 and 19 from moving upstream along the path of a slab passing between the circular discs 12 and 14. In this position the floating rings 17 and 19 rotate freely between the circular discs 12 and 14, press the split strands 21 away from the circular discs 12 and 14 and thus the strands 21 exit from the rotating disc splitter without jamming between the circular discs 12 and 14.

The pressure in the pneumatic cylinders 28 and 30 may be varied as desired. Thus the force of the floating rings 17 and 19 pressing against the strands 21 may be varied depending upon the thickness of the slab 20 so that the strands 21 are cleared from between the circular discs 12 and 14. At the same time the pressure is not so great as to prevent the slab 20 from advancing through the rotating disc splitter.

In practice, it is found that the splits in the slab 20 commence upstream of the circular discs and tend to follow the grain in the wood. If the grain is not straight this can cause the slab 20 to move sideways which can result in the circular discs 12 and 14 cutting as well as splitting. In general, it is found that a certain amount of cutting invariably occurs because the split does not exactly follow the line corresponding to the interfitting discs. The cutting generally occurs across the grain of the wood. Such action generally results in additional fibers in the form of splinters being produced. Such products are not desirable, thus as much as possible, slabs having cross grain or a plurality of knots therein are not used for passing through the rotating disc splitter.

In one embodiment of the invention, the circular discs had 15½ inches outside diameter and were ⅝ of an inch thick. The floating spacer rings were of the same thickness, had an outside diameter of 19¾ inches and had an inside diameter of 12¾ inches. The outside diameter of the spacer hubs keyed to the shafts was 5½ inches. The fixed position rolls and the movable position rolls were each four inches in diameter. The thickness of the slabs was approximately ½ an inch and the resulting strands were somewhat narrower than ⅝ of an inch due perhaps to the strands fanning outwards at the crack or the commencement of the split in the slab. The strands were substantially straight, and no jamming of the strands between the circular discs occurred.

The overlapping mesh between the discs 12 and 14 is preferably about ⅛ of an inch. However, this distance may be adjusted depending on the trunnions supporting the first shaft 10 and the second shaft 11. The trunnions themselves have not been shown but include standard antifriction bearings in trunnions forming part of the main frame 27. In the drawings, the floating rings 17 and 19 have a larger diameter than the discs 12 and 14 thus offering a larger diameter curved surface to the strands 21 exiting from between the discs, and pushing the strands away from the discs. However, the discs 12 and 14 and the floating rings 17 and 19 may have the same outside diameter.

The fixed rollers 22 and 23 may have annular ribs which contact all of the floating rings 17 and 19 pushing them further downstream than the discs 12 and 14. Since the floating rings are further downstream, the contact point between the floating rings and the strands is also further downstream and may be positioned at the point where the rotating discs cease contacting the strands. This ensures that the strands are clearly pushed out from between the discs without any jamming occurring. In another embodiment, the annular ribs are omitted.

While the invention has been described in terms of its preferred embodiments, it will be apparent to those skilled in the art that various changes may be made in the details of the rotating disc splitter and method of using the same without departing from the scope of the present invention which is limited only by the claims.

I claim:

1. An apparatus for splitting a slab of wood into strands with longitudinal-grain extending along their length, comprising, a first rotary shaft and a second rotary shaft whose axes are parallel, a first series of spaced-apart circular discs centered on and secured to the first shaft, a second series of spaced-apart circular discs centered on and secured to the second shaft, positioned so that the second series discs interfit in slightly overlapping relationship with the first series discs, means for rotating the first shaft and the second shaft in counter rotating directions adapted to pull a slab of wood between the first and second series discs and split the slab into strands, a first series of floating spacer rings on the first shaft interspaced between the first series discs, positioned to rest adjacent the second series discs when no slab passes therethrough, a second series of floating spacer rings on the second shaft interspaced between the second series discs, positioned to rest adjacent the first series discs when no slab passes therethrough, fixed roller means positioned upstream of the first and second shafts to prevent the first and second series spacer rings from moving upstream of the first and second series discs, and pressure movable roller means positioned on the downstream side of the first and second shafts, adapted to permit the first and second series spacer rings to move away from the second and first series discs respectively when a slab is being split therebetween, said upstream and downstream roller means adapted to provide a point of contact between the floating rings and the wood strands which is downstream of the axes of said first and second shafts.

2. The apparatus according to claim 1 wherein the axis of the first rotary shaft is vertically above the axis of the second rotary shaft and wherein the fixed roller means is positioned at a radial angle to the horizontal from the center of the circular discs within the approximate range of 20° to 70° upstream of the first and second series discs.

3. The apparatus according to claim 1 wherein the pressure movable roller means comprises a first roller pushing against the first series spacer rings and a second roller pushing against the second series spacer rings, by means of at least one pneumatic cylinder per roller.

4. The apparatus according to claim 3 wherein the pressure roller means has a variable pressure by a variable pressure valve to the pneumatic cylinders.

5. The apparatus according to claim 1 wherein the first series and second series discs have the same outside diameter and the first series and second series spacer rings have a larger outside diameter than said discs.

6. The apparatus according to claim 1 wherein the second series discs overlap the first series discs by a distance of approximately ⅛ of an inch.

7. The apparatus according to claim 1 wherein the fixed roller means upstream of the first and second shafts respectively have annular ribs adapted to pass between adjacent rotating discs, the ribs of said fixed roller means contacting the first and second series spacer rings.

8. A method of splitting a slab of wood substantially along the grain into a plurality of strands, comprising the steps of, inserting an end of a slab of wood between counter rotating discs mounted on a first rotary shaft and a second rotary shaft whose axes are parallel, a first series of spaced-apart circular discs centered on and secured to the first shaft, and a second series of spaced-apart circular discs centered on and secured to the second shaft and positioned so that the second series discs interfit in slightly overlapping relationship with the first series discs, said first series of discs pushing first sections of the slab in one direction perpendicular to the direction of travel of the slab and perpendicular to the axes of the counter rotating discs, said second series of discs interfitting with the first series of discs pushing second sections of the slab between the first sections in an opposite direction to the one direction thus causing splitting to occur between first sections and second sections of the slab and forming strands, and guiding the first sections and second sections of the slab downstream of the counter rotating discs to issue as substantially straight strands from the counter rotating discs.

* * * * *